US007584783B2

(12) United States Patent
O'Malley

(10) Patent No.: US 7,584,783 B2
(45) Date of Patent: Sep. 8, 2009

(54) SURFACE ACTIVATED DOWNHOLE SPARK-GAP TOOL

(75) Inventor: Edward J. O'Malley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 264 days.

(21) Appl. No.: 11/434,685

(22) Filed: May 16, 2006

(65) Prior Publication Data

US 2006/0260804 A1 Nov. 23, 2006

(51) Int. Cl.
*E21B 43/25* (2006.01)

(52) U.S. Cl. ..... 166/65.1; 166/177.1; 166/249; 166/68.5

(58) Field of Classification Search ..... 166/249, 166/177.1, 65.1, 68.5; 175/104
See application file for complete search history.

(56) References Cited

U.S. PATENT DOCUMENTS

| | | | | | |
|---|---|---|---|---|---|
| 3,172,456 | A | * | 3/1965 | Glasgow et al. | 431/27 |
| 3,180,418 | A | | 4/1965 | MacLeod | 166/43 |
| 3,500,942 | A | | 3/1970 | Smith, Jr. | 175/16 |
| 3,506,076 | A | * | 4/1970 | Angona | 175/57 |
| 3,544,165 | A | | 12/1970 | Snedden | 299/14 |
| 3,576,219 | A | * | 4/1971 | Angona | 175/4.5 |
| 3,708,022 | A | | 1/1973 | Woodruff | 175/16 |
| 3,756,319 | A | | 9/1973 | Holm et al. | 166/304 |
| 4,074,758 | A | | 2/1978 | Scott | 166/249 |
| 4,164,978 | A | | 8/1979 | Scott | 166/249 |
| 4,169,503 | A | | 10/1979 | Scott | 166/65 |
| 4,345,650 | A | | 8/1982 | Wesley | 166/249 |
| 4,518,888 | A | * | 5/1985 | Zabcik | 310/334 |
| 5,301,169 | A | | 4/1994 | Baria et al. | |
| 5,313,954 | A | | 5/1994 | Schwarze et al. | 128/702 |
| 5,409,002 | A | | 4/1995 | Pell | 128/653.1 |
| 6,768,214 | B2 | | 7/2004 | Schultz et al. | 290/1 |

OTHER PUBLICATIONS

James R. Ammer, James C. Furness, Michael L. Wilkey, Donald O. Johnson; "Well Bore Remediation Using Sonication."
R.V. Westermark, SPE, D.R. Maloney, SPE; "Enhanced Oil Recovery with Downhole Vibration Stimulation;" SPE 67303.

(Continued)

*Primary Examiner*—Giovanna C Wright
(74) *Attorney, Agent, or Firm*—Cantor Colburn LLP

(57) ABSTRACT

A spark-gap tool includes a plurality of electrodes, a mandrel, transductive element(s), and a force transmission configuration. Upon relative movement between components a physical distortion of one or more transductive elements occurs, whereby an electrical potential is generated. A method for powering the spark-gap tool is by physically distorting one or more transductive elements by moving components axially and/or rotationally. A method for treating a borehole is by physically distorting one or more transductive elements thereby creating sufficient voltage potential to cause an arc of selected magnitude across a spark-gap in the tool. A downhole power generation arrangement includes a first member and a second member that are movable and a piezoelectric element on one of the first member and the second member and in force transmissive communication with the other of the first member and the second member.

21 Claims, 4 Drawing Sheets

OTHER PUBLICATIONS

Brian Champion, SPE, Gerrit Nitters, SPE; "The Application of High Power Sound Waves for Wellbore Cleaning;" SPE 82197.

Fred van der Bas, Eric de Rouffignac, Pedro Zuiderwijk, Sau-Wai Wong, Diederik va Batenburg, Bob Nirchak, Kwang Yoo; "Radial Near Wellbore Stimulation by Acoustic Waves;" SPE 86492.

Xiao Guo, Zhimin Du, Guangquan Li, Shengli Oilfield, Zhuangzhi Shu, Dianqiangui Oilfield; "High Frequency Vibration Recovery Enhancement Technology in Heavy Oil Fields of China;" SPE 86956.

Aziz Harthy, SPE, "Screen and Near-Wellbore Cleaning and Stimulation Tools Evaluation: Recent Experience in Well Operation;" SPE 89653.

* cited by examiner

SURFACE ACTIVATED DOWNHOLE SPARK-GAP TOOL

BACKGROUND

Spark-gap tools are known in the hydrocarbon industry. These tools have not, however, gained strong acceptance in permanent completions primarily because they require a large voltage to function acceptably. Such voltage is often delivered to the spark-gap tool in a downhole environment through electrical conductors from a surface supply system. As one of ordinary skill in the art clearly recognizes, the longer the electrical conductor, the greater the voltage drop. For this reason the voltage at the surface supply needs to be even greater than that required to produce an acceptable arc at the spark-gap tool. Since many rig operators are uncomfortable with utilizing systems employing greater than 200 volts from a surface supply, the spark-gap tools' functionality has been limited. Moreover, because of the electrical requirements, other compromises are also made throughout the wellbore to accommodate power at the site of the spark-gap tool. Each of the above issues creates a lack of interest in the industry in using the spark-gap tools.

SUMMARY

Disclosed herein is a spark-gap tool which includes a housing, a plurality of electrodes at the housing, a mandrel nested with the housing, transductive element(s) located at one of the housing and the mandrel, and a force transmission configuration located at the other of the housing, and the mandrel, the initiator, upon relative movement between the housing and the mandrel, causing a physical distortion of one or more transductive elements, whereby an electrical potential is generated by the one or more transductive elements.

Further disclosed herein is a method for powering the spark-gap tool by physically distorting one or more transductive elements cyclically by moving the mandrel within its housing axially and rotationally thereby creating sufficient voltage potential to cause an arc of selected magnitude across a spark-gap in the tool.

Further disclosed herein is a method for treating a borehole by physically distorting one or more transductive elements thereby creating sufficient voltage potential to cause an arc of selected magnitude across a spark-gap in the tool.

Further disclosed herein is a downhole power generation arrangement including a first member, a second member, at least one of the first member and second member being movable relative to the other of the first member and the second member; and a piezoelectric element of one of the first member and the second member and in force transmissive communication with the other of the first member and the second member, at least one of the first member and the second member being mechanically movable from a surface location.

BRIEF DESCRIPTION OF THE DRAWINGS

Referring now to the drawings wherein like elements are numbered alike in the several Figures.

DETAILED DESCRIPTION

Figure 1A:
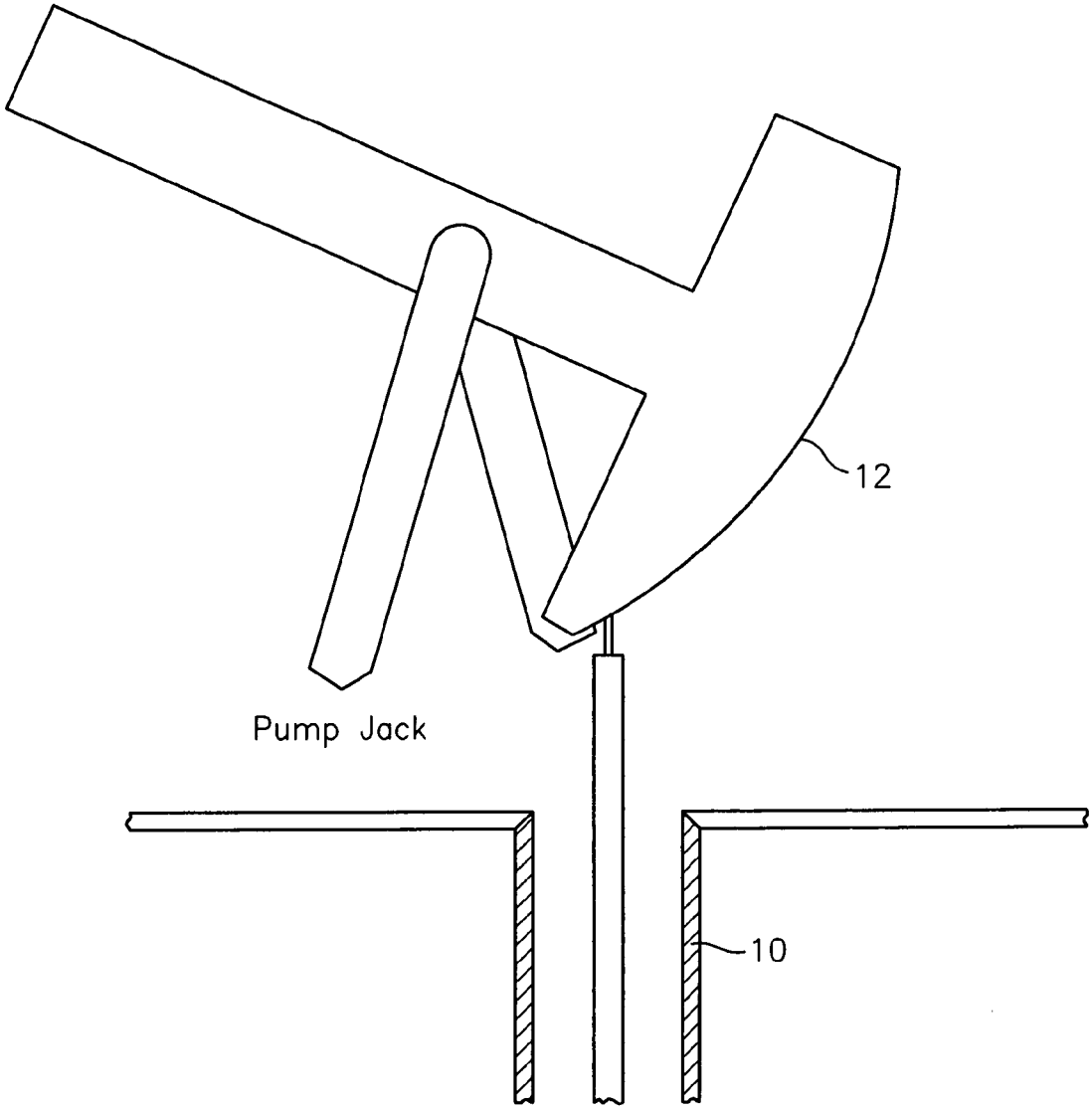
FIGS. 1A and 1B are an extended schematic elevation view of a wellbore with the spark-gap tool deployed therein.
Figure 1B:
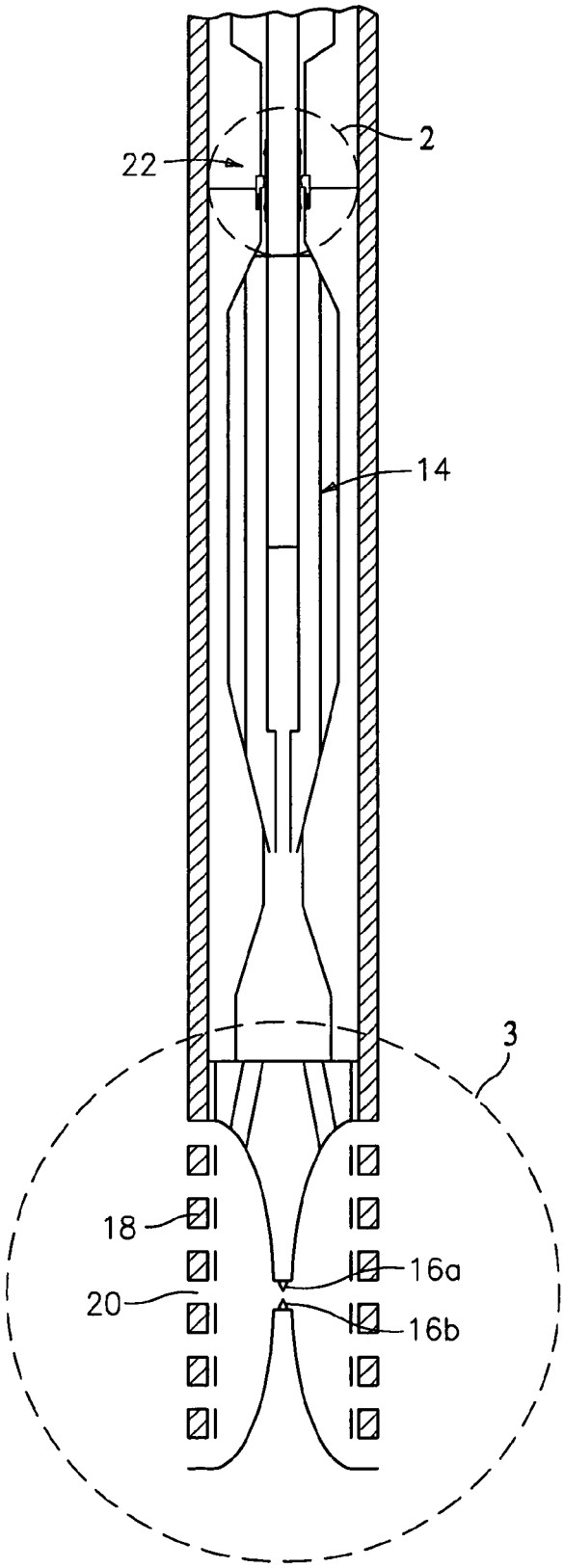

Referring to FIGS. 1A and 1B, an overview is provided of a wellbore 10, a pump jack 12 for a rod pump and a spark-gap tool 14. As illustrated, the spark-gap tool includes a pair of electrodes 16*a* and 16*b* located within a section of pipe 18 having a plurality of openings 20. Further illustrated, generally, is a voltage generation arrangement 22. With arrangement 22 utilizing mechanical function in conjunction with one or more transducers, the problem in the prior art of supplying high voltage from surface and carrying that voltage to the spark tool has been eliminated. Because the voltage generation arrangement can be located proximate the spark-gap electrodes 16*a* and 16*b*, voltage loss (due to distance) is not a factor.

Figure 2:
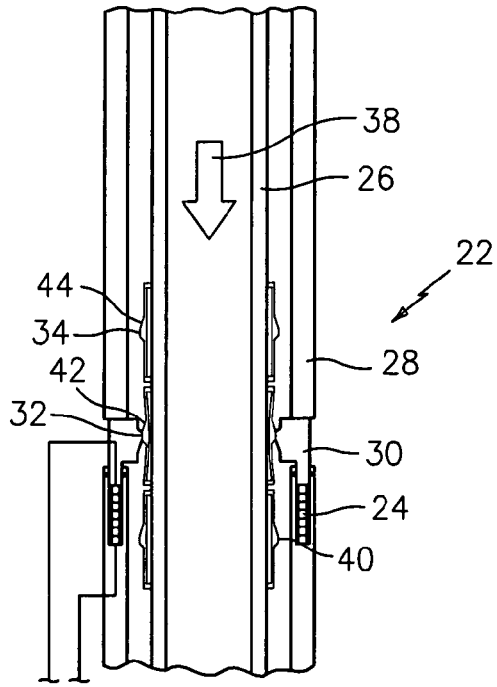
FIG. 2 is an expanded view of the circumscribed Section 2-2 in FIG. 1B.

Referring to FIG. 2, one embodiment of a mechanical voltage generation arrangement 22 is depicted in more detail. Central to this embodiment is a piezoelectric element 24 (transductive element). A piezoelectric element is a transducer and thereby capable of creating a voltage potential when subjected to a mechanical energy input in any selected direction or combination of directions causing physical distortion of the element.

In this embodiment, mechanical energy input is provided through a configuration described hereunder, to the piezoelectric element(s) 24 to produce the desired voltage. In specific embodiments hereof, the mechanical energy may be imparted to the element(s) 24 any number of times from one to infinity in order to produce a buildup of charges or a continuous charge or some combination of these. In one embodiment, the mechanical energy is provided by set down weight of an inner mandrel 26 of the spark-gap tool 14. Set down weight is operative when a tool housing 28 of the spark-gap tool 14 is anchored such that the mandrel 26 is moveable relative to the tool housing 28. The housing 28 may be anchored within casing 10 in any of a number of conventional ways and not shown. Because of the anchoring of the housing 28, that housing will no longer move downhole when further set down weight from the pump rig 12 is applied to the mandrel 26. Such application of mechanical energy is transmitted to a compression piston 30 (embodiment of force transmission configuration), which in turn is force transmissive communication with the piezoelectric element(s) 24. Mechanical energy (more generically deformative energy, which may include hydraulic, pneumatic, and even optic energy could be used. The phrase "mechanical energy" as used herein is intended to also encompass these other ways of physically distorting the element(s) 24.) applied to the compression piston causes a compression of the piezoelectric element 24 thereby creating the desired voltage potential in that element. It should be noted in passing that the piezoelectric element contemplated may be of a single crystalline variety or a polycrystalline variety, such as a ceramic material. Single crystalline varieties are more efficient but also are more costly to procure. Some ceramic materials operable as piezoelectric materials include barium titanate, lead zirconate, lead titanate, and lead zirconate titanate, etc. Since most ceramic materials are composed of random crystalline structure, in order to reliably produce the desired voltage potential upon mechanical energy input, the ceramic material must be polarized thereby aligning the individual crystals therein prior to use to generate a voltage potential. Polarization allows the structure to act more like a single crystalline piezoelectric material. Axiomatically, single crystalline varieties of piezoelectric elements do not require poling prior to use. The voltage potential generated is proportional to the thickness of the material in element 24 and the amount of physical distortion of the element, in turn related to the applied force thereon. In this particular embodiment the compression piston 30 is configured, at an internal dimension thereof, with a profile 32. The profile 32 includes specific features allowing it to engage and then release a collet mechanism or series of collet mechanisms 34. The specific features are rounded ridge type projections known in the art. Such ridges transfer a load until a predetermined maximum load is reached whereafter the ridge yields and drops the load.

Figure 3:
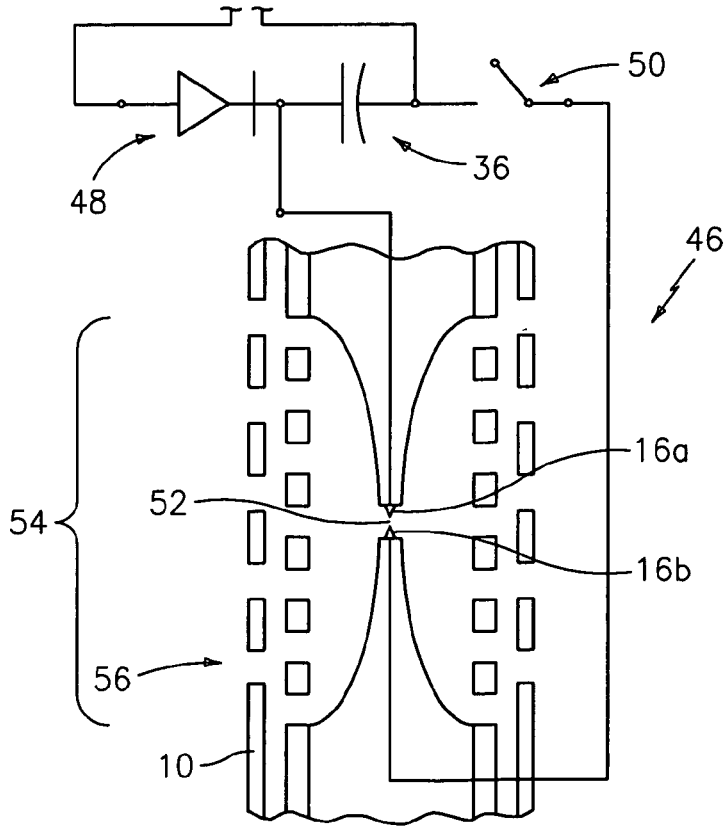
FIG. 3 is an expanded view of the circumscribed view Section 3-3 in FIG. 1B.

In the particular embodiment illustrated in FIG. 3, collet mechanisms 34 are depicted. As illustrated, this embodiment provides for voltage buildup in a capacitor 36 by creating multiple compressive and release cycles on the piezoelectric element 24. As the mandrel 26 moves in the direction of arrow 38, profile 32 of compression piston 30 is picked up on collet ridge 40 and released, then picked up on collet ridge 42 and released, and then picked up on collet ridge 44. As illustrated, collet ridge 42 is at the release position with the collet 34 deforming to allow the ridge 42 to release the piston 30. During each compression cycle, the piezoelectric element generates a voltage which is sent for storage to the capacitor 36. As the collet mechanism 34 deflects, the compression piston 30 is released thereby removing mechanical energy from the piezoelectric element 24. This will, in turn, eliminate the production of voltage from the piezoelectric element 24 and reset it to its natural position. Upon further motion of the mandrel 26, the next ridge 42 picks up profile 32, transmitting mechanical energy once again to the piezoelectric element 24. Upon release of each ridge 40, 42, 44, the collet mechanism 34 is deflected regularly inwardly relative to the mandrel 26. This can be seen in FIG. 2 with respect to the collet mechanism ridge 42. Although three collet mechanisms 34 are illustrated, more or fewer can be utilized as desired. Limitation in the number of collet mechanisms employable relates only to stroke possibilities for the mandrel 26. This may be limited by the pump jack 12 on the surface or may be limited by available open space within the wellbore or within the tool. In the illustrated embodiment, in order to generate additional voltage, one need merely move the mandrel 26 uphole resetting the collet mechanism(s) for a further movement in the downhole direction and thereby create three more pulsed electrical signals to be stored in the capacitor. Depending upon exactly how much voltage a particular application requires, the above-stated procedure may be repeated indefinitely to fully charge the capacitor prior to creating an arc across the electrodes 16*a* and 16*b*.

Referring to FIG. 3, the spark-gap portion 46 is illustrated very schematically. The device comprises a rectifier diode 48, the capacitor identified previously as 36, and a switch 50 which completes the circuit to either side of the spark-gap 52. Once the circuit is completed, electrodes 16*a* and 16*b* function together to generate an arc that jumps over the spark-gap. Upon the formation of the arc, fluid located in the spark-gap 52 is vaporized and a shockwave is initiated. Referring back to FIG. 1, and still referring to FIG. 3, this embodiment illustrates that the tool housing 28 includes perforated interval 54 located adjacent to spark-gap 52. The perforated interval may be a slotted pipe, a holed pipe, or other construction configured to allow propagation of the shockwave generated at spark-gap 52 through the tool housing 28. Since it may be desirable to propagate the shockwave into the formation itself, a casing segment radially outwardly disposed of the spark-gap tool would also have a perforated interval, schematically illustrated as 56.

Figure 4:
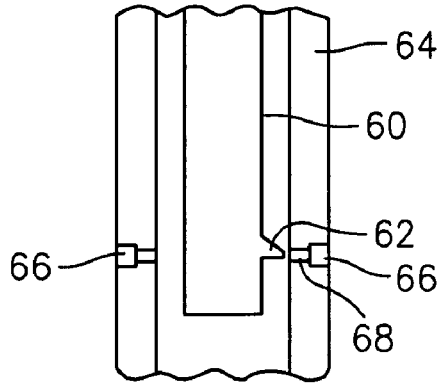
FIG. 4 is a schematic elevation view of an alternate voltage operation arrangement.

Mechanical energy may also be imparted utilizing rotational initiation. Referring to FIG. 4, a rotary mandrel 60 may be provided with one or more actuator bumps 62. In a tool housing 64 surrounding the mandrel 60, one or more piezoelectric elements 66 are installed. In this embodiment, one or more compression pistons 68 are located between the piezoelectric elements 66 and the bump or bumps 62. It is noted that in some applications the pistons 68 may be omitted and contact between bump or bumps 62 directly with element or elements 66 may be had. Upon rotation of mandrel 60, sequential elements 66 will be compressed and released. This will generate a voltage potential which may then be stored in a capacitor similar to that depicted in FIG. 3 or may simply be used without storage if appropriate for the application. This arrangement will then be connected to the spark-gap electrodes.

Figure 5:
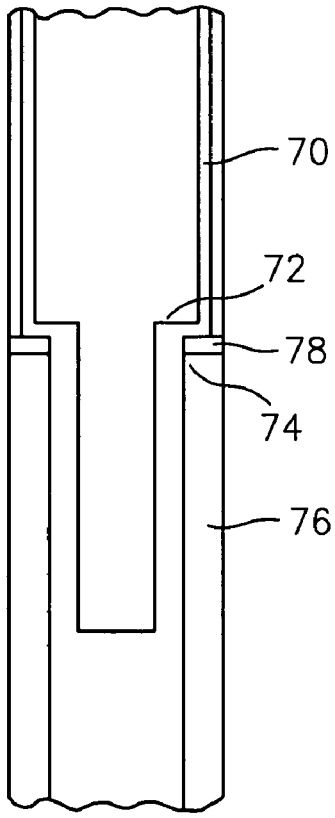
FIG. 5 is a schematic elevation view of another alternate voltage generation arrangement.

In yet another embodiment of the mechanical energy arrangement, referring to FIG. 5, a mandrel 70 is configured with a shoulder 72 that has an offset profile such that a portion of shoulder 72 will be in contact with a relatively small portion of a counter shoulder 74 located within the spark-gap tool housing 76. Located at 78, around the periphery of housing 76, is one or more piezoelectric elements which can be mechanically compressed one after the other as mandrel 70 rotates. It should also be noted that a compression piston arrangement such as, for example, a metal disk may be placed atop the element 78 to protect them from direct frictional degradation due to rotation of mandrel 70 but still allow the compressive force of shoulder 72 to cause the desired voltage potential in element(s) 78. As is clear from the drawing, however, such disk is not required but merely is optional.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A spark-gap tool comprising:

a housing;

a plurality of electrodes at the housing;

a mandrel nested with the housing;

one or more transductive elements located at one of the housing and the mandrel; and a force transmission configuration located at the other of the housing and the mandrel;

a interconnection at the at the force transmission configuration to connect the force transmission configuration to a rod pump, the rod pump in use initiating relative movement between the housing and the mandrel, causing a physical distortion of one or more of the one or more transductive elements, whereby an electrical potential is generated by the one or more transductive elements.

2. A spark-gap tool as claimed in claim 1, wherein the plurality of electrodes includes a ground.

3. A spark-gap tool as claimed in claim 1, wherein the force transmission configuration is a compression piston.

4. A spark-gap tool as claimed in claim 1, wherein the force transmission configuration is a profile at one of the mandrel and the housing.

5. A spark-gap tool as claimed in claim 4, wherein the profile at a shoulder at the mandrel.

6. A spark-gap tool as claimed in claim 1, wherein one of the mandrel and the housing includes one or more collet mechanisms.

7. A spark-gap tool as claimed in claim 6, wherein each of the one or more collet mechanisms includes a profile thereon.

8. A spark-gap tool as claimed in claim 6, wherein each of the one or more collet mechanisms is deflectable.

9. A spark-gap tool as claimed in claim 1, wherein the tool further comprises an electrode in operable communication with the electrical potential.

10. A spark-gap tool as claimed in claim 1, wherein the tool further comprises a capacitor in operable communication with the one or more transductive elements.

11. A method for powering a spark-gap tool comprising:

physically distorting one or more transductive elements with a rod of a hydrocarbon recovery rod pump downhole hydrocarbon recovery;

creating sufficient voltage potential to cause an arc of selected magnitude across a spark-gap in the tool.

12. A method for powering a spark-gap tool as claimed in claim 11, wherein the distorting is by moving a mandrel within a housing.

13. A method for powering a spark-gap tool as claimed in claim 12, wherein the distorting is cyclical.

14. A method for powering a spark-gap tool as claimed in claim 12, wherein the moving is axial.

15. A method for powering a spark-gap tool as claimed in claim 11, wherein the distorting is by unidirectionally moving a mandrel within a housing.

16. A method for treating a borehole comprising:

physically distorting one or more transductive elements with a rod of a rod pump;

creating sufficient voltage potential to cause an arc of selected magnitude across a spark-gap in the tool;

creating a shockwave by discharging voltage across the spark-gap; and propagating the shockwave.

17. A downhole power generation arrangement comprising:

a first member;

a second member, at least one of the first member and second member being movable relative to the other of the first member and the second member; and a piezoelectric element at one of the first member and the second member and in force transmissive communication with the other of the first member and the second member, at least one of the first member and the second member being mechanically movable, the movement being caused by a rod pump.

18. A downhole power generation arrangement as claimed in claim 17, wherein at least one of the first member and the second member is mechanically movable in an axial direction relative to the other of the first member and the second member.

19. A downhole power generation arrangement comprising:

a first member;

a second member, at least one of the first member and second member being movable relative to the other of the first member and the second member;

a piezoelectric element of at one of the first member and the second member and in force transmissive communication with the other of the first member and the second member, at least one of the first member and the second member being mechanically movable from a surface location; and a ratchet mechanism allowing a single movement of one of the first member and second member relative to the other of the first member and second member to cause a repetitive mechanical loading and unloading of the piezoelectric element.

20. A rod pump for a hydrocarbon wellbore comprising:

a spark-gap tool including:

a housing;

a plurality of electrodes at the housing;

a mandrel nested with the housing;

one or more transductive elements located at one of the housing and a rod of the rod pump; and a force transmission configuration located at the other of the housing and the mandrel;

the rod operably coupled to the force transmission configuration, movement of the rod causing a physical distortion of one or more of the one or more transductive elements, whereby an electrical potential is generated by the one or more transductive elements.

21. A wellbore system comprising:

a rod pump in operable communication with the weilbore;

a spark-gap tool in operable communication with the rod pump, the spark gap tool including:

a housing;

a plurality of electrodes at the housing;

a mandrel nested with the housing;

one or more transductive elements located at one of the housing and the mandrel; and a force transmission configuration in operable communication with the rod pump located at the other of the housing and the mandrel, the initiator, upon relative movement between the housing and the mandrel, causing a physical distortion of one or more of the one or more transductive elements, whereby an electrical potential is generated by the one or more transductive elements.

* * * * *